United States Patent [19]

Kunik et al.

[11] 3,982,631

[45] Sept. 28, 1976

[54] DISPENSING CASE FOR NEEDLES OR THE LIKE

[75] Inventors: I. Jordan Kunik; Maurice Goodman, Jr., both of New York, N.Y.

[73] Assignees: I. Jordan Kunik; Maurice Goodman, Jr., both of New York, N.Y. ; part interest to each

[22] Filed: Oct. 17, 1974

[21] Appl. No.: 515,497

[52] U.S. Cl. ..... 206/380; 206/350; 206/818; 211/DIG. 1; 223/109 A

[51] Int. Cl.[2] ..... A41H 31/00; B65D 85/24

[58] Field of Search ..... 206/45.15, 45.18, 350, 206/380, 818; 211/150, 170, DIG. 1; 220/22, 334, 339; 229/44 R; 248/206 A; 223/109 A

[56] References Cited

UNITED STATES PATENTS

| | | | |
|---|---|---|---|
| 2,129,175 | 9/1938 | Hassenfeld | 206/45.15 |
| 2,476,102 | 7/1949 | Lobell | 206/45.18 X |
| 2,888,136 | 5/1959 | La Borde | 206/350 |

*Primary Examiner*—Steven E. Lipman
*Attorney, Agent, or Firm*—I. Jordan Kunik

[57] ABSTRACT

A dispenser container wherein magnetizable needles, tools, or the like, are mounted upon a magnet element secured pivotally to the interior of the container by means of a fabric hinge. The pivoting motion of the magnetic bar is produced by the alternating forward and retracting movements of the cover or closure element for the container whereby the needles move into a substantially horizontal position when the container is closed. When the cover is retracted, the pivoting motion of the magnet induced by gravity causes the needles to move pivotally whereby the freely extending forward portions thereof extend externally of the container to facilitate individual selection.

8 Claims, 9 Drawing Figures

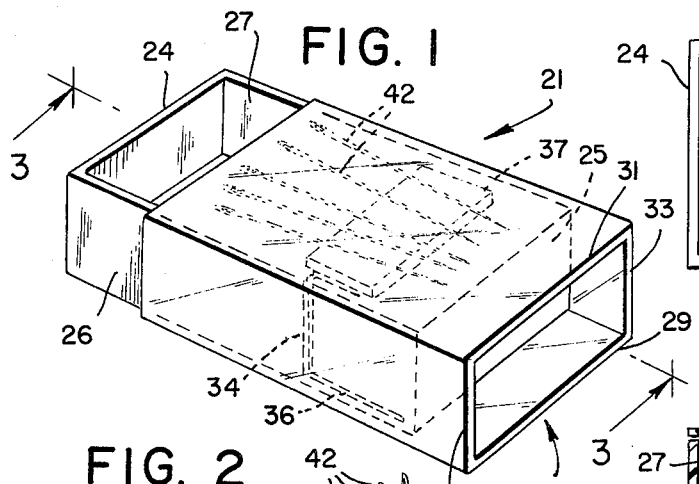
FIG. 1
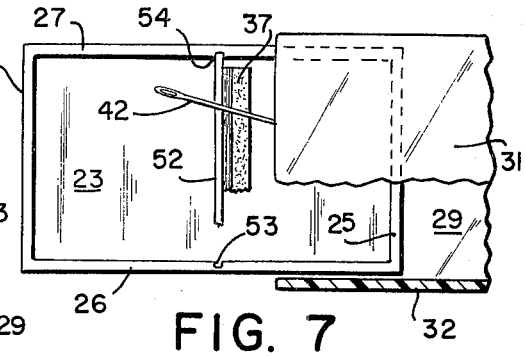
FIG. 7
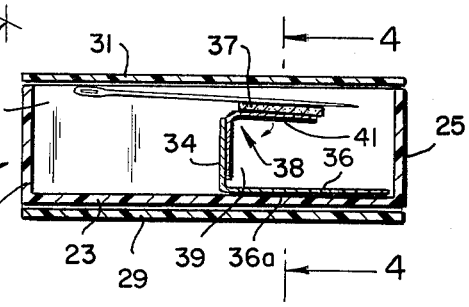
FIG. 3
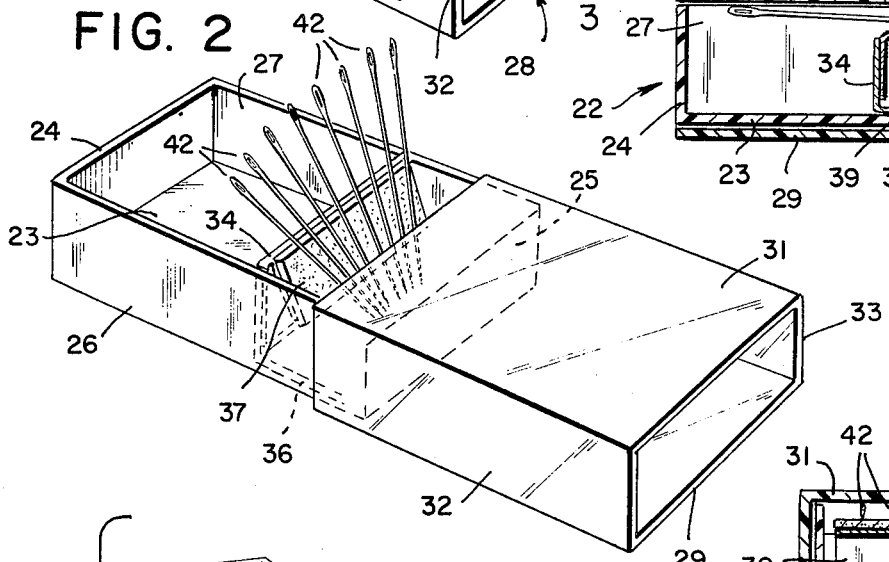
FIG. 2
FIG. 4
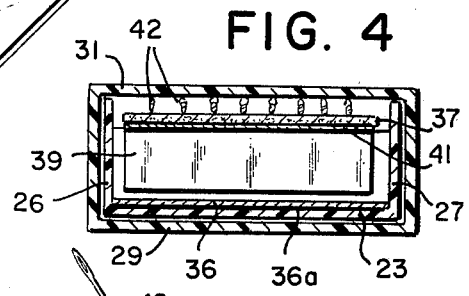
FIG. 5
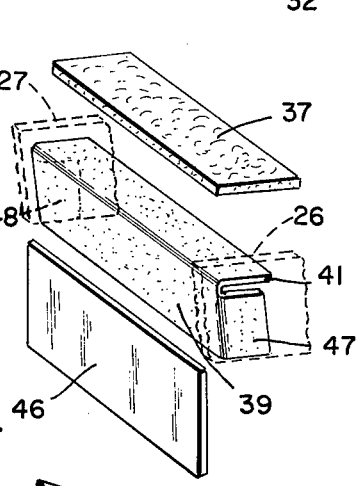
FIG. 8
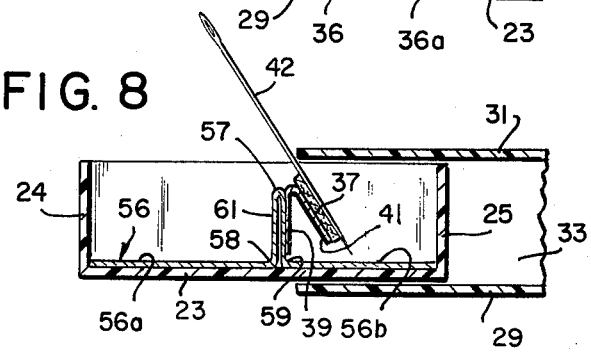
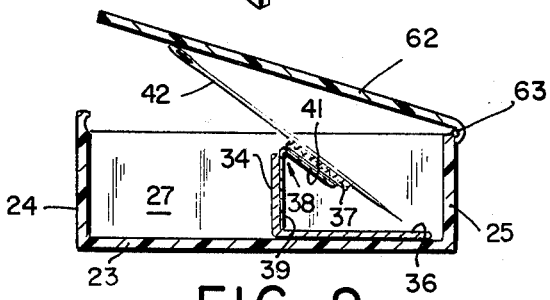
FIG. 9
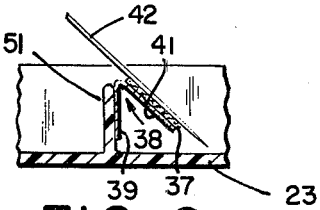
FIG. 6

DISPENSING CASE FOR NEEDLES OR THE LIKE

BACKGROUND OF THE INVENTION

1. Field of the Invention

This invention relates to dispenser containers and more particularly to a device for packaging needles, tools, or the like, whereby the opening and closing of the container causes the alternating pivoting motion of said needles between a completely enclosed condition and an angled position where free portions thereof project from the container for selection by the operator.

2. Description of the Prior Art

Previous devices for the same purpose comprised containers having a pivotable magnet bar that was mounted in the case by means of a pivot pin that required the drilling of accommodating holes in the side walls of the container. Furthermore, it was necessary to bond the magnet bar upon the pivot pin which entailed an incovenient and time-consuming operation. Since a needle case should be extremely inexpensive in view of the fact that needles themselves are very inexpensive, the cost of producing the previous needle cases was prohibitive and prevented the commercial exploitation thereof. Accordingly, it was necessary to overcome these cost factors in order to provide a commercially feasible needle case that would be acceptable for marketing in this field.

SUMMARY OF THE INVENTION

The present invention eliminates the cost of a pivot pin, the incovenient bonding thereof of the magnet bar and the drilling of holes in the side walls of the case to accommodate the ends of the pivot pins and the labor cost in assembling these component parts. The improvements of the present invention comprise the provision of a partition in the container and a flexible fabric hinge that is bonded both to the partition and to the magnet support bar for pivotal action of the latter relative to the partition. By utilizing the piece of fabric which may in the form of cloth, paper, plastic, or the like, and which has a pressure sensitive adhesive material on one flat surface thereof, it is a simple matter merely to press a portion of the fabric to the partition and another portion of the magnet support bar thereby quickly and easily forming a flexible hinge element which is comparatively inexpensive and which can be assembled by unskilled labor or by automatic means at practically minute cost.

Since it is important for the needles and the like to have maximum contact with the magnet, the fabric flexible hinge element must pivotally interconnect the support partition and the magnet in such a manner as not to obstruct the working surface of the magnet. Accordingly, one portion of the fabric is bonded to the rear portion only of the partition and only upon the underneath surface of the magnet pivotally opposing the partition. Thus, the needles or the like are enabled to make operational contact with the entire respective coacting surface of the magnet without any obstruction.

Although in some embodiments it may be possible to provide a partition integrally formed with the container for supporting the hinge and magnet, the present invention also discloses several novel means for providing the partition element in less expensive and easily assembled structures.

These and other novel features and advantages of the present invention will be described and defined in the following specification and claims.

BRIEF DESCRIPTION OF THE DRAWINGS

FIG. 1 is a perspective view of one embodiment of a partially open dispenser container of the present invention, with some parts being shown in dotted outline, the needles being illustrated in the position when the container is closed or partially closed;

FIG. 2 is a somewhat enlarged perspective view of the device shown in FIG. 1 with the closure element further retracted and showing portions of said needles projecting upwardly from the container;

FIG. 3 is a view taken on line 3—3 of FIG. 4 but with the outer closure element shown in the completely closed position;

FIG. 4 is a view taken on line 4—4 of FIG. 3;

FIG. 5 is an exploded view of another embodiment of the magnet mounting assembly showing a means for securing a separate partition element within the container;

FIG. 6 is a fragmentary section view of a center portion of the container illustrating an integrally formed partition element;

FIG. 7 is a fragmentary top view of another embodiment of the invention showing a partition element that is secured in the slotted walls of the container;

FIG. 8 is a longitudinal section view of another embodiment of the device wherein the partition element is formed of self-supporting folded material; and FIG. 9 is a longitudinal section view of another embodiment of the invention showing a partially retracted hinged closure for the container.

DESCRIPTION OF THE PREFERRED EMBODIMENTS

Referring now to the drawings in detail, FIGS. 1–4 illustrate one embodiment of the invention in the form of a two-piece rectangular box-like container, generally designated 21, which includes an inner open-top box, generally designated 22, having a floor 23, vertical spaced end walls 24 and 25, and vertical spaced side walls 26 and 27. Cooperating slidably with inner box 22 is an outer integrally formed sleeve or closure, generally designated 28, formed of spaced bottom and top walls 29 and 31 and spaced side walls 32 and 33. The respective dimensions of box 22 and open ended sleeve 28 are such as to form a snug and easily sliding fit relative to one another.

The two components 22 and 28 may be made selectively of a suitable material such as transparent, translucent or opaque plastic, cardboard, fiberboard, wood, or other suitable material.

In some embodiments, bottom wall 29 and side walls 32 and 33 may be dispensed with if the longitudinal edges of top wall 31 as a unitary element cooperate with suitable longitudinal grooves on the top portions of walls 26 and 27 that would be suitably formed to accommodate such a sliding cover element. Other suitable equivalent means may be provided to form a sliding cover element alternately opening and closing the open top of box 22.

Located in the interior of box 22 is a vertical laterally extending partition 34 located intermediate end walls 24 and 25. The outer vertical ends of partition 34 may extend up to or about the interior surfaces of side walls 26 and 27, respectively. In some embodiments, the outer end walls of partition 34 may be cemented or otherwise bonded to the respective inner surfaces of walls 26 and 27. In the embodiment illustrated in FIGS. 1–4, partition 34 has an integrally formed, horizontally extending base 36 which extends toward end wall 25 of box 22. Partition 34 and base 36 may be made of a suitable firm or stiff material such as plastic, fiberboard, cardboard, or the like, so that said partition will stand firmly upright when the bottom surface of base 36 is bonded to the top surface of floor 23 by means of a thin layer 36*a* of cement or other suitable adhesive material. Layer 36*a* may take the form of a small spot sufficient to cause suitable adherence between the juxtaposed elements. Thus, the unitary integrally formed separate L-shaped element comprising partition 34 and base 36 obviates the necessity of otherwise providing a more expensive partition that would be integrally formed in box 22.

The device herein includes a rectangular support magnet 37 which is mounted pivotally relative to partition 34 by means of a flexible fabric hinge, generally designated 38, one laterally extending stationary portion 39 thereof being cemented or otherwise bonded to one vertical surface of partition 34. Support magnet 37 is cemented or otherwise bonded to the other portion 41 of hinge 38 so that said magnet is movable pivotally relative to said partition. Hinge 38 may be made of any suitable material such as cloth, paper, Fiberglas, plastic such as cellophane or impregnated cloth tape and the like. For sake of clarity of illustration, the thickness of hinge 38 has been exaggerated in the drawing. In one embodiment, hinge 38 may originally be coated on one surface thereof with a pressure sensitive adhesive which facilitates the bonding thereof both to partition 34 and to support magnet 37. Other suitable bonding materials may be utilized. Because of the flexibility and strength of the material of which hinge 38 is made, it can be subjected to multitudinous flexures without any appreciable wear and without losing any appreciable flexibility, strength, or deformation. The self-adhesive hinge 38 may be applied assembled into the apparatus with great facility and without the use of any special skills.

It is essential that hinge 38 be applied to the rear surface of partition 34 and upon the bottom or pivotally opposing surface of magnet 37. If hinge 38 were to be applied to the front surface of partition 34 and to the top surface of magnet 37, in order to provide for pivoting action therebetween, it is obvious that the portion of hinge 38 covering a portion of top surface of magnet 37 would seriously interfere with the efficacy of the apparatus since it is necessary that the magnetizable elements such as needles or the like make contact with the entire top surface of magnet 37. Any fabric, such as hinge 38, that might be interposed between the top surface of magnet 37 and the needles would seriously diminish the magnetic interaction between said magnet and said needles.

Removably mountable upon support magnet 37 is a plurality of magnetizable elements 42 such as needles, pins, drill bits, elongated tools, cutting instruments, or the like. With the lines of magnetic force suitably constituted upon and within support magnet 37, the magnetizable elements 42 will naturally displace themselves in a spaced array as illustrated in FIGS. 1, 2 and 4, whereby a single element 42 may be readily selected from the group of elements without interference from adjacent elements.

When outer sleeve 28 is retracted, as shown in FIG. 2, the weight of support magnet 37 causes the downward pivoting movement of hinge portion 41 by gravity whereby said magnet assumes an acute angle relative to partition 34. The magetizable elements 42 mounted on said magnet also assume the same angled position whereby the outer end portions of said elements extend upwardly and outwardly of box 21 so that any one of them may be selected for use or replaced upon the support magnet.

When outer sleeve 28 is moved into the completely closed position as illustrated in FIG. 3, the forward laterally extending edge of top wall 31 impinging upon magnetizable elements 42 causes the pivoting action thereof into a horizontal or near horizontal position with the simultaneous pivoting action being performed by support magnet 37 and hinge portion 41 by virtue of the magnetic adherence of said magnet to said magnetizable elements. Thus, the opening and closing of box 21 by retracting and propelling sleeve 28 relative to inner box 22 causes the pivoting motion of elements 42 and of support magnet 37 adhering thereto.

Instead of utilizing an L-shaped element comprising partition 34 and base 36 as in FIGS. 1–4, it is possible to provide a unitary separate rectangular partition 46 as shown in FIG. 5. Partition 46 may be secured in an upright position by means of adding to hinge portion 39 outwardly extending, integrally formed wings 47 and 48, the adhesive surfaces of which are secured to the inner vertical surfaces of walls 26 and 27, respectively, whereby said partition 46 serves as a pivot support for magnet 37 bonded upon movable pivot portion 41.

Another embodiment for supporting the hinge element and the support magnet is illustrated in FIG. 6 where the laterally extending partition 51 is integrally formed with the floor 23 of inner box 22.

Another alternative for supporting the hinge element and support magnet is illustrated in FIG. 7 where laterally extending partition 52 is supported vertically in vertical notches 53 and 54 in side walls 26 and 27, respectively.

FIG. 8 shows another alternative structure for supporting the hinge element and support magnet 37. A rectangular sheet, generally designated 56, of a suitable stiff or semi-stiff material such as paper, cardboard, plastic, or the like, is scored or otherwise dented at transverse score lines 57, 58 and 59, or the like, after which it is bent and folded on said lines as illustrated in FIG. 8 to form a vertical, transversely extending double-layered partition 61. The longitudinal length of sheet 56 is determined whereby a snug press fit may be established between the ends of legs 56*a* and 56*b* thereof and the bottom inner surface of end walls 24 and 25 so that the folds formed at score lines 57, 58 and 59, provide a firm vertical standing partition 61 which has sufficient strength to support the fabric hinge element and support magnet 37. In other embodiments where sheet 56 is shorter, then legs 56*a* and 56*b* may be bonded or otherwise secured to floor 23.

While sheet 56 in FIG. 8 has been described as being made of foldable material, it is understood that said sheet, together with vertical partition 61, may be made of a single, unitary molded or otherwise formed piece of plastic or composition board in the shape of an inverted T whereby the outwardly extending arms of said T-shaped element may be removably inserted into the container and fixed in position either by a press fit between the outer ends of the legs and the inner surfaces of the respective end walls, or by means of a suitable bonding material as described in connection with cement 36*a* in FIG. 3. In both embodiments shown in FIGS. 3 and 8, respective partition elements are preformed in suitable dimensions and after being preassembled with fabric hinges 38 and magnetic elements 37, those subassemblies are dropped into and fixed in position within the respective containers. By this means, the construction cost of the device in accordance with the present invention is considerably reduced by the assembly operations described herein.

It is to be noted that in the embodiments of FIGS. 5, 6, 7 and 8, hinge portion 39 is applied to the rear surface of each of the vertical partitions in the respective Figures, and hinge portion 41 is applied to the underside of magnet element 37 in the same manner described hereinbefore in connection with FIGS. 1–4, in order to ensure that there be no interference between the top surface of said magnetic element and magnetizable elements 42.

Illustrated in FIG. 9 is another embodiment of the invention in which the slide closure illustrated in the previous Figures is replaced by cover 62 pivotally connected to box 22 by means of a hinge 63. The opening and closing of cover 62 will produce the same pivoting action upon the needles and upon support magnet 37 as performed by the slide cover.

Although the present invention has been described with reference to particular embodiments and examples, it will be apparent to those skilled in the art that variations and modifications can be substituted therefor without departing from the principles and true spirit of the invention. The "Abstract" given above is for the convenience of technical searchers and is not to be used for interpreting the scope of the invention or claims.

I claim:

1. A dispenser container for magnetizable elements such as needles, tools, and the like, comprising an open top rectangular box having spaced side walls and spaced end walls, a vertical partition in said box and disposed transversely relative thereto intermediate said end walls, a magnet element, a strip of fabric forming a flexible hinge between said partition and said magnet for pivotal action of the latter relative to the former, one portion of said strip being bonded to the rear surface of said partition and the other portion of said strip being bonded to the lower surface of said magnet that pivotally opposes said rear surface of said partition, said magnetizable elements making unobstructed operational contact with the free upper surface of said magnet.

2. The container according to claim 1 wherein said partition has at least one horizontally extending leg integrally formed therewith, said leg being secured to the floor of said box, the substance of said leg and partition being selected of sufficient firmness to cause said partition to maintain its vertical orientation relative to said box.

3. The container according to claim 2 and further comprising a bonding substance interposed between the bottom surface of said leg and the upper surface of said floor for securing said leg and said partition firmly in position within said box.

4. The container according to claim 1 wherein said partition is a unitary rectangular element freely insertable into said box and wherein said fabric strip further comprises lateral extensions on both sides of that portion of the strip being bonded to said partition, said extensions being bonded to respective side walls of said box to secure said partition therein firmly in a vertical position.

5. The container according to claim 1 wherein said partition and said magnet are assembled pivotally prior to insertion into said box, at least one horizontally extending leg integrally formed with said partition, said partition and magnet assembly and said leg being insertable into said box with said leg being secured to the floor of said box.

6. The container according to claim 5 wherein said partition has a forwardly extending leg and a rearwardly extending leg integrally formed therewith, both of said legs being secured to the floor of said box.

7. The container according to claim 1 wherein said partition is formed of a strip of material the original length of which is greater than the interior longitudinal dimension of said box, said strip being folded intermediate its ends to form a double layer vertical partition standing intermediate the end walls of said box, the remainder of said strip being folded into horizontal legs on both sides of the bottom of said formed partition, said forward and rearward legs resting upon the floor of said box and being secured thereto.

8. The container according to claim 1 wherein said partition is formed of a strip of material, the original length of which is greater than the interior longitudinal dimension of said box, said strips being folded intermediate its ends to form a double layer vertical partition standing intermediate the end walls of said box, the remainder of said strip being folded into horizontal legs on both sides of the bottom of said formed partition and resting upon the floor of said box, the longitudinal dimension between the outer ends of said legs being determined to form a press fit with the inner surface of the end walls of said box to maintain said legs secured in said box and to maintain said partition in a vertical position.

* * * * *